US009382649B2

(12) United States Patent
Yuikawa et al.

(10) Patent No.: US 9,382,649 B2
(45) Date of Patent: Jul. 5, 2016

(54) WARP KNITTED FABRIC AND METHOD OF MANUFACTURING SAME

(75) Inventors: Kyoichi Yuikawa, Fukui (JP); Isao Honda, Fukui (JP); Fumio Shirasaki, Fukui (JP)

(73) Assignee: Seiren Co., Ltd., Fukui (JP)

( * ) Notice: Subject to any disclaimer, the term of this patent is extended or adjusted under 35 U.S.C. 154(b) by 261 days.

(21) Appl. No.: 13/997,798

(22) PCT Filed: Dec. 22, 2011

(86) PCT No.: PCT/JP2011/007231

§ 371 (c)(1),
(2), (4) Date: Aug. 1, 2013

(87) PCT Pub. No.: WO2012/090460

PCT Pub. Date: Jul. 5, 2012

(65) Prior Publication Data

US 2013/0298612 A1 Nov. 14, 2013

(30) Foreign Application Priority Data

Dec. 29, 2010 (JP) ..... 2010-294542

(51) Int. Cl.
*A47C 31/00* (2006.01)
*D04B 23/16* (2006.01)
(Continued)

(52) U.S. Cl.
CPC ..... *D04B 23/16* (2013.01); *D04B 21/02* (2013.01); *D04B 21/20* (2013.01); *A47C 31/006* (2013.01); *D10B 2403/0114* (2013.01); *D10B 2505/08* (2013.01)

(58) Field of Classification Search
CPC ..... D04B 21/00; D04B 21/06; D04B 21/02; D04B 21/20; D04B 23/16
USPC ..... 66/195, 192, 193, 84 A
See application file for complete search history.

(56) References Cited

U.S. PATENT DOCUMENTS 3,570,270 A * 3/1971 Koppenburg ..... 66/193
4,425,398 A * 1/1984 Berczi ..... 442/314
(Continued)

FOREIGN PATENT DOCUMENTS

DE 29622399 2/1997
JP 63-315651 12/1988
(Continued)

OTHER PUBLICATIONS textil-informationen kettenwirk praxis 3/87 Vorberichte ITMA 87; ISSN-0047-3405.
(Continued)

*Primary Examiner* — Danny Worrell
*Assistant Examiner* — Jocelyn Wu
(74) *Attorney, Agent, or Firm* — Norris McLaughlin & Marcus, P.A.

(57) ABSTRACT

A warp knitted fabric to be used for an epidermis material to avoid stickiness and dampness due to sweating when one is seated for a long time, and which is light-weight and provides superior functionality; has a denbigh stitch texture or a cord stitch textureformed by supplying a base yarn by a front guide bar of a warp knitting machine having at least two guide bars, supplying an insertion yarn by a guide bar rearward of the front guide bar to knit an insertion texture, and knitting the insertion yarn underlapping the insertion yarn in the same direction and by an amount corresponding to the same number of needles as the underlapping of the base yarn supplied by the front guide bar, whereby the insertion yarn is exposed at a sinker-loop-side surface of a warp knitted fabric intermittently in a warp direction.

12 Claims, 14 Drawing Sheets

(51) Int. Cl.
*D04B 21/20* (2006.01)
*D04B 21/02* (2006.01)

(56) References Cited

U.S. PATENT DOCUMENTS

| | | | | |
|---|---|---|---|---|
| 4,450,196 | A * | 5/1984 | Kamat | 428/197 |
| 4,704,757 | A * | 11/1987 | Young | 15/104.94 |
| 5,065,599 | A * | 11/1991 | Groshens | 66/84 A |
| 6,079,236 | A * | 6/2000 | Ives et al. | 66/170 |
| 6,233,978 | B1 * | 5/2001 | Gehring et al. | 66/195 |
| 6,389,851 | B1 * | 5/2002 | Groshens | 66/192 |
| 7,213,421 | B2 * | 5/2007 | Shirasaki et al. | 66/193 |
| 2003/0101776 | A1 * | 6/2003 | Shirasaki et al. | 66/196 |
| 2004/0237597 | A1 * | 12/2004 | Oya et al. | 66/195 |
| 2006/0107701 | A1 * | 5/2006 | Ternon et al. | 66/195 |
| 2006/0172646 | A1 | 8/2006 | Shirasaki et al. | |
| 2007/0089466 | A1 * | 4/2007 | Ikeguchi et al. | 66/195 |
| 2011/0056248 | A1 * | 3/2011 | Suzuki et al. | 66/195 |
| 2011/0247370 | A1 * | 10/2011 | Akao et al. | 66/195 |
| 2014/0230118 | A1 * | 8/2014 | Koizumi | 2/60 |

FOREIGN PATENT DOCUMENTS

| | | |
|---|---|---|
| JP | 6-173147 | 6/1994 |
| JP | 9-13253 | 1/1997 |
| JP | 2005-126884 | 5/2005 |
| JP | 2006-104620 | 4/2006 |
| JP | 2007-84965 | 4/2007 |
| JP | 2010-95829 | 4/2010 |
| JP | 4583125 | 9/2010 |
| JP | 4902421 | 3/2012 |
| WO | WO-2004/088021 | 10/2004 |

OTHER PUBLICATIONS textil-informationen kettenwirk praxis 4/88; ISSN-0047-3405. Warp Knitting; pp. 55-56.

* cited by examiner

| KNITTING MACHINE | HKS3M (28 gauges) | | |
|---|---|---|---|
| TYPE OF YARN | POLYESTER:56dtex/24f | POLYESTER:56dtex/24f | POLYESTER:56dtex/24f |
| GUIDE BAR NO. | GB3 | GB2 | GB1 |
| KNITTING PATTERN |  | | |

WARP KNITTED FABRIC AND METHOD OF MANUFACTURING SAME

BACKGROUND OF THE INVENTION

The present invention relates to a warp knitted fabric used as an epidermis material for seats such as automotive vehicles, railroad vehicles, aircrafts, child seats, baby carriages, wheelchairs, furniture, and office chairs and, more specifically, to the warp knitted fabric which resolves stickiness or dampness at the time of sweating, and is light-weight and superior in functionality, and a method of manufacturing the same.

A warp knitted fabric is used in various fields such as clothing and industrial materials.

Among others, when used as an epidermis material for seats such as automotive vehicles, railroad vehicles, aircrafts, child seats, baby carriages, wheelchairs, furniture, and office chairs which are seated for a long time, stickiness or dampness at the time of sweating come to an issue.

In order to solve the problem as described above, for example, International Publication WO/2004/088021 discloses that a solid structure warp knitted fabric in which the number of loops of a base texture on one side is smaller than that on the other side, characterized in that the smaller number of loops of the base texture is 30 to 75% of the larger number of loops of the same, so that the solid structure warp knitted fabric free from stickiness even when one sweats because the base texture surface having the smaller number of loops is used so as to come into contact with human bodies (skin surfaces), and hence a surface area coming into contact with the skin is small can be provided.

In contrast, JP-A-06-173147 discloses that a warp knitted fabric, which is a hairy warp knitted fabric, but having high air permeability and giving no damp to a driver even when used for a vehicle upholstered fabric, characterized in that a pile fuzz standing out from the surface of the knitted fabric is configured by lapping a base knitted fabric having the net holes with sinker loops formed so as to extend beyond the net holes can be provided.

However, the warp knitted fabrics as PTLs 1 and 2 are effective for resolving stickiness and dampness when used under contact with human bodies, but have a problem of increase in weight.

In addition, Japanese Patent No. 4583125 discloses a provision of a solid structure warp knitted fabric haying superior air permeability and having a soft texture by inserting floating yarns (insertion yarns) while forming a floating portion at a predetermined ratio by engaging the floating yarns with a surface of the base texture by an insertion knitting.

JP-A-2006-104620 discloses that in a case where insertion yarns are underlapped, when a direction and the number of times of underlapping is to be matched to those of an underlap of base yarns supplied from another guide bar, insertion yarns are exposed at a sinker loop surface side (an inner surface of a double raschel), while when not to be matched to those of the underlap of the base yarns supplied from another guide bar, the insertion yarns are exposed at a needle loop surface side (the outer surface of the double raschel).

In these case as well, these configurations are not effective for resolving stickiness and damp when used under contact with human bodies and achieving weight reduction.

SUMMARY OF INVENTION

In view of such a problem, the present invention provides a warp knitted fabric used mainly as an epidermis material for seats such as automotive vehicles, railroad vehicles, aircrafts, child seats, baby carriages, wheelchairs, furniture, and office chairs, which is capable of resolving stickiness or dampness at the time of sweating when used in a state of sitting for a long time and is light-weight and superior in functionality, and a method of manufacturing the same.

Solution to Problem

A warp knitted fabric according to the present invention that solves the above-described problem is knitted by a warp knitting machine having at least two guide bars, and includes: a denbigh stitch texture or a cord stitch texture formed by a base yarn supplied from a front guide bar; and an insertion texture formed by an insertion yarn supplied from the guide bar rearward of the front guide bar, and is characterized in that the insertion yarn is exposed at a sinker-loop-side surface of the warp knitted fabric intermittently in a warp direction. In particular, the insertion yarn is knitted by being underlapped in the same direction and by an amount corresponding to the same number of needles as an underlap of the base yarn supplied by the front guide bar, thereby being exposed at the sinker-loop-side surface of the warp knitted fabric intermittently in the warp direction.

In the warp knitted fabric of the invention described above, one or a plurality of rows of exposed portions of the insertion yarn in the warp direction are formed in parallel in the warp direction at required intervals in a knitting width direction, and also at positions shifted alternately by one or a plurality of rows.

In the warp knitted fabric of the invention described above, the insertion yarn is a yarn different in color or type from the base yarn, and the exposed portion thereof may be expressed as a pattern on the sinker-loop-side surface.

In the warp knitted fabric of the invention described above, at least one of a chain stitch texture, the denbigh stitch texture, and the cord stitch texture is formed by another base yarn supplied by the guide bar rearward of the guide bar configured to supply the insertion yarn, a portion of the insertion yarn not exposed at the sinker-loop-side surface is sandwiched between a stitch texture formed by the base yarn supplied by the front guide bar and the stitch texture formed by the other base yarn supplied by a back guide bar.

Also, the present invention as a method of manufacturing the warp knitted fabric described above includes: knitting the denbigh stitch texture or the cord stitch texture by supplying a base yarn by the front guide bar by the warp knitting machine having at least two guide bars; supplying the insertion yarn by the guide bar rearward of the front guide bar to knit an insertion texture; and underlapping the insertion yarn in the same direction and by an amount corresponding to the same number of needles as the underlapping of the base yarn supplied by the front guide bar, characterized in that the insertion yarn is exposed at the sinker-loop-side surface intermittently in the warp direction.

In the method of manufacturing the warp knitted fabric described above, one or a plurality of courses of the portions where the insertion yarn supplied by the guide bar rearward of the front guide bar is underlapped and inserted and one or a plurality of courses of the portions where the insertion yarn is inserted in the warp direction without being underlapped are knitted repeatedly and alternately in the warp direction.

In the case described above, the insertion yarn is engaged with loops formed at courses before and after the portions where the insertion yarn is underlapped and inserted, and may be continued to the portion to be inserted in the warp direction without being underlapped.

According to the present invention, in the method of manufacturing the warp knitted fabric described above, one or a plurality of courses of the portions where the insertion yarn supplied by the guide bar rearward of the front guide bar may be underlapped and inserted and one or a plurality of courses of knitted portions where the loops are formed at the respective courses and engaged by knitting are knitted repeatedly and alternately in the warp direction.

In the method of manufacturing of the warp knitted fabric according to the respective inventions described above may include using two the guide bars as guide bars for supplying the insertion yarn, supplying the insertion yarns alternately in the knitting width direction by two of the respective guide bars, knitting the insertion yarns from the both guide bars by underlapping in the same direction by the same number of needles as the underlap of the base yarn supplied by the front guide bar, thereby exposing the insertion yarns from the both guide bars to the sinker-loop-side surface intermittently in the warp direction.

In the method of manufacturing the warp knitted fabric of the respective inventions described above may include forming at least one of the chain stitch texture, the denbigh stitch texture, and the cord stitch texture by supplying another base yarn supplied by the guide bar rearward of the guide bar configured to supply the insertion yarn, and knitting so as to sandwich and hold the portion of the insertion yarn not exposed at the sinker-loop-side surface between the stitch texture formed by the base yarn supplied by the front guide bar and the stitch texture formed by the other base yarn supplied by the back guide bar.

According to the warp knitted fabric and the method of manufacturing the same of the present invention, the exposed portion of the insertion yarns exposed at the sinker-loop-side surface intermittently hold partially the protrusions of sinker loops of base yarns, so that the surface of the warp knitted fabric is formed with fine concavities and convexities. Therefore, in a case where the warp knitted fabric of the present invention is used as the epidermis material of the seat, for example with the sinker-loop-side surface used as the front, the contact surface area with respect to the human body at the time of being seated is reduced and hence the air-permeability is improved, so that stickiness and damp at the time of seating is resolved.

In addition, since the insertion texture is used for forming the fine concavities and convexities on the sinker-loop-side surface, the length of the yarn (amount of yarn) required for forming the warp knitted fabric may be reduced, so that a light-weight warp knitted fabric is achieved.

In addition, by holding the sinker loops by the insertion yarns, the physical property, more specifically, the anti-pilling performance, and the abrasion resistance are improved.

Therefore, the warp knitted fabric obtained by the present invention may be used preferably as the epidermis material for the seats such as automotive vehicles, railroad vehicles, aircrafts, child seats, baby carriages, wheelchairs, furniture, and office chairs, so that light-weight and superior functionality are achieved.

DETAILED DESCRIPTION OF THE INVENTION

An embodiment of the present invention will be described on the basis of examples illustrated in drawings.

Figure 1:
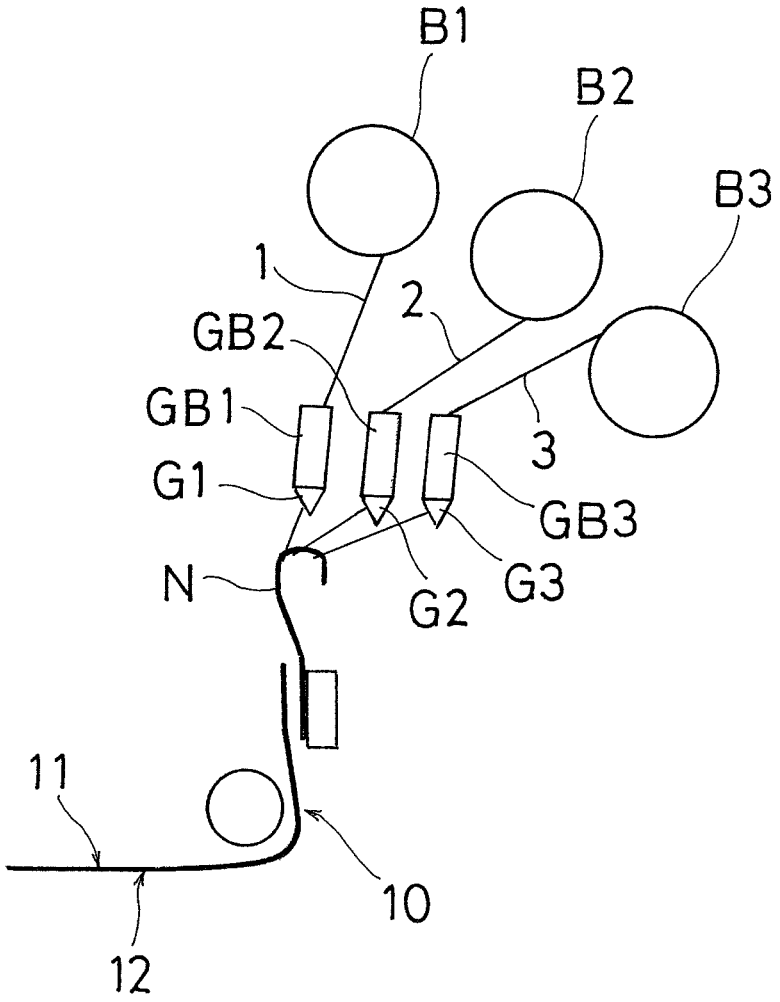
FIG. 1 is a schematic drawing illustrating a principal portion of a warp knitting machine used for knitting a warp knitted fabric of the present invention.

A warp knitted fabric 10 of the present invention is knitted by a warp knitting machine of 14 to 36 gauges provided with at least two guide bars, for example, three guide bars GB1, GB2, GB3 including one middle guide bar as schematically illustrated in FIG. 1. In particular, the warp knitting machine having 18 to 32 gauges is preferable. In the case of gauges smaller than 14 gauge, intervals of loops in a width direction is large and hence insertion yarns may have difficulty in being fixed. When exceeding 36-gauge, the strength of a knitted fabric may not be sufficient. Examples of the warp knitting machines described above include a tricot knitting machine, a raschel knitting machine, and a double raschel knitting machine.

FIG. 1 illustrates a principal portion of the tricot knitting machine, N denotes the number of knitting needles arranged in parallel in the width direction of a knitting machine, GB1 to GB3 respectively denote the guide bars used for knitting, G1 to G3 denote guide portions that allows insertion of knitting yarns as base yarns 1, 3 and insertion yarns 2 therethrough, and B1 to B3 denotes beams of the respective knitting yarns.

In knitting of the warp knitted fabric 10 of the present invention, for example, when knitting the same by the warp knitting machine provided with three guide bars GB1 to GB3, a front guide bar GB1 on a front side of the knitting machine (the side where the position of the guide bar becomes farthest from a row of the knitting needles at the time of underlapping)

is used as a base guide bar that supply base yarns 1, and a denbigh stitch texture or a so-called cord stitch texture in which a stitch is formed (looped) while underlapping to the left and the right alternately from one course to another is knitted, and at least one guide bar GB2 arranged rearward of the front guide bar GB1, for example, the middle guide bar as illustrated in the a drawing is used as the insertion guide bar that supplies the insertion yarns 2 to knit an inserted texture.

Furthermore, by using a back guide bar GB3 disposed rearward of the guide bar (middle guide bar) GB2 as the inserted guide bar as another base guide bar configured to supply base yarns 3 different from that described above, at least one of a chain stitch texture, the denbigh stitch texture, and the cord stitch texture. There is a case where the stitch texture of the other base yarns 3 supplied by the back guide bar GB3 is not included depending on the stitch texture of the warp knitted fabric 10 to be manufactured. In this case, the stitch texture of the base yarns 1 of the front guide bar GB1 corresponds to the base texture of the warp knitted fabric 10. As described above, by overlapping the knitted fabric of the other base yarns 3 supplied by the back guide bar GB3, the portions of the insertion yarns 2 not underlapped but inserted into a warp direction and exposed at a needle loop side surface may easily be fixed, and the strength or elastic properties of an obtained warp texture are improved. Therefore, in practical, a mode including the stitch texture of the other base yarns 3 supplied by the back guide bar GB3 is preferable.

In the case of the present invention, in the knitting described above, the insertion yarns 2 supplied by the one guide bar (middle guide bar) GB2 are knitted by underlapping in the left and the right (knitting width direction) alternately across several courses in a knitting direction and matching the direction and the number of needles of the underlap of the insertion yarns 2 to those of the underlap of the base yarns 1 supplied by the front guide bar GB1 and underlapping the insertion yarns 2 in the same direction as an underlap of the base yarns 1 by an amount corresponding to the same the number of needles, thereby being knitted so as to form the portions 2*a* exposed at a sinker-loop-side surface 11 across a sinker loops 1*a* of the base yarns 1 and a portion exposed not to the sinker-loop-side surface 11 but to a needle-loop-side surface 12 or held by a base texture of the warp knitted fabric 10 alternately and intermittently in the warp direction.

Figure 4:
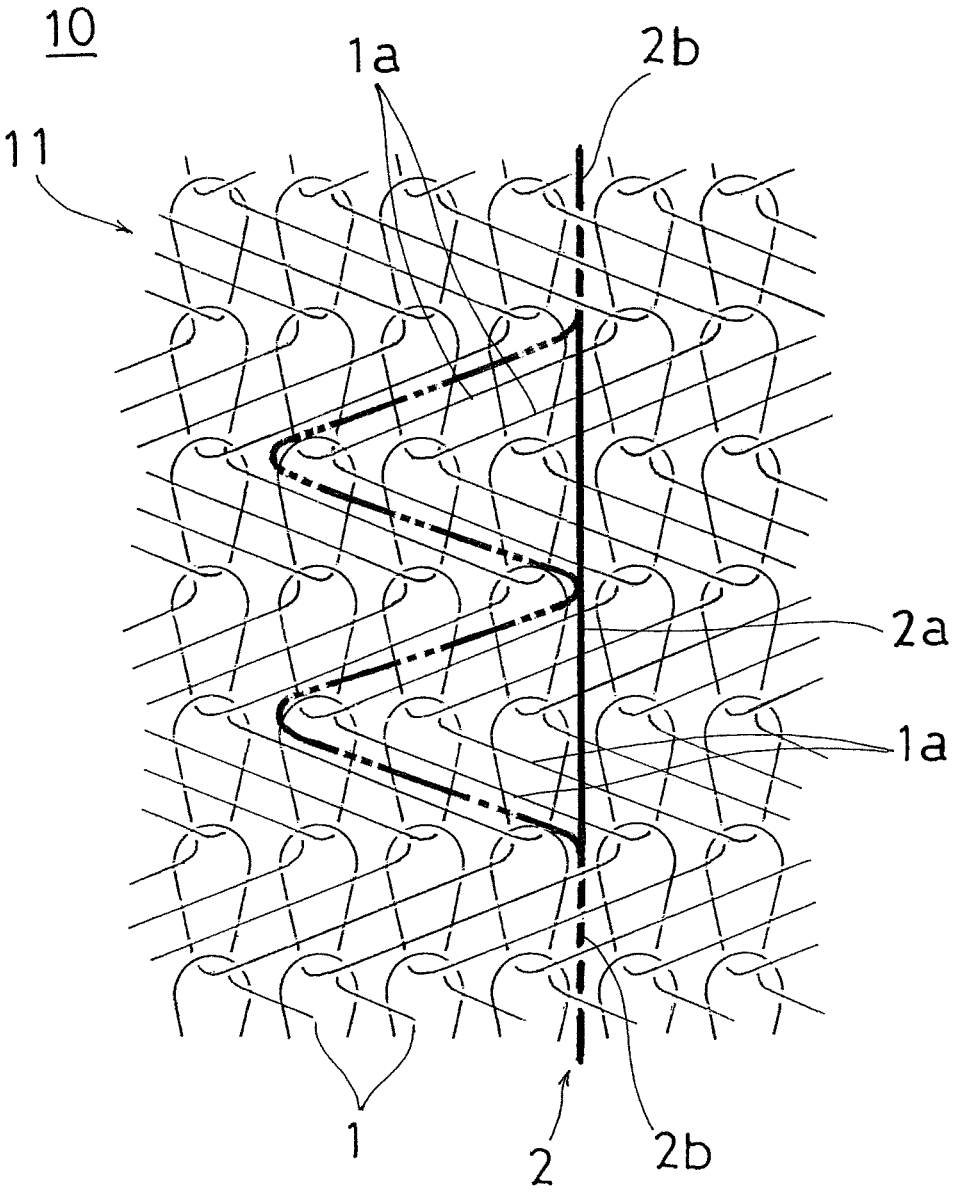
FIG. 4 is a schematic explanatory drawing illustrating an exposed state of insertion yarns.

In other words, by underlapping the insertion yarns 2 in the same direction as the base yarns 1 by an amount corresponding to the same number of needles so as to match the direction and the number of needles of the underlap of the base yarns 1, the portion inserted by being underlapped (indicated by double-dashed chain line) cannot be held by the sinker loops 1*a* of the base yarns 1, and is exposed at the sinker-loop-side surface 11 across the sinker loops 1*a* as indicated by a solid line in the same drawing, so that the exposed portions 2*a* hold the sinker loops 1*a* of the base yarns 1 as illustrated in FIG. 4. If the direction and the number of needles of the underlap of the insertion yarns 2 is not matched to the direction and the number of needles of the base yarns 1, the portions where the insertion yarns 2 are underlapped and inserted are held by the sinker loops 1*a* of the intersecting base yarns 1 and hence are not exposed at the sinker-loop-side surface 11 and are hidden by the stitch texture of the base yarns 1 which constitutes the base texture of the warp knitted fabric 10 whereby the warp knitted fabric 10 of the present invention cannot be obtained.

Figure 6:
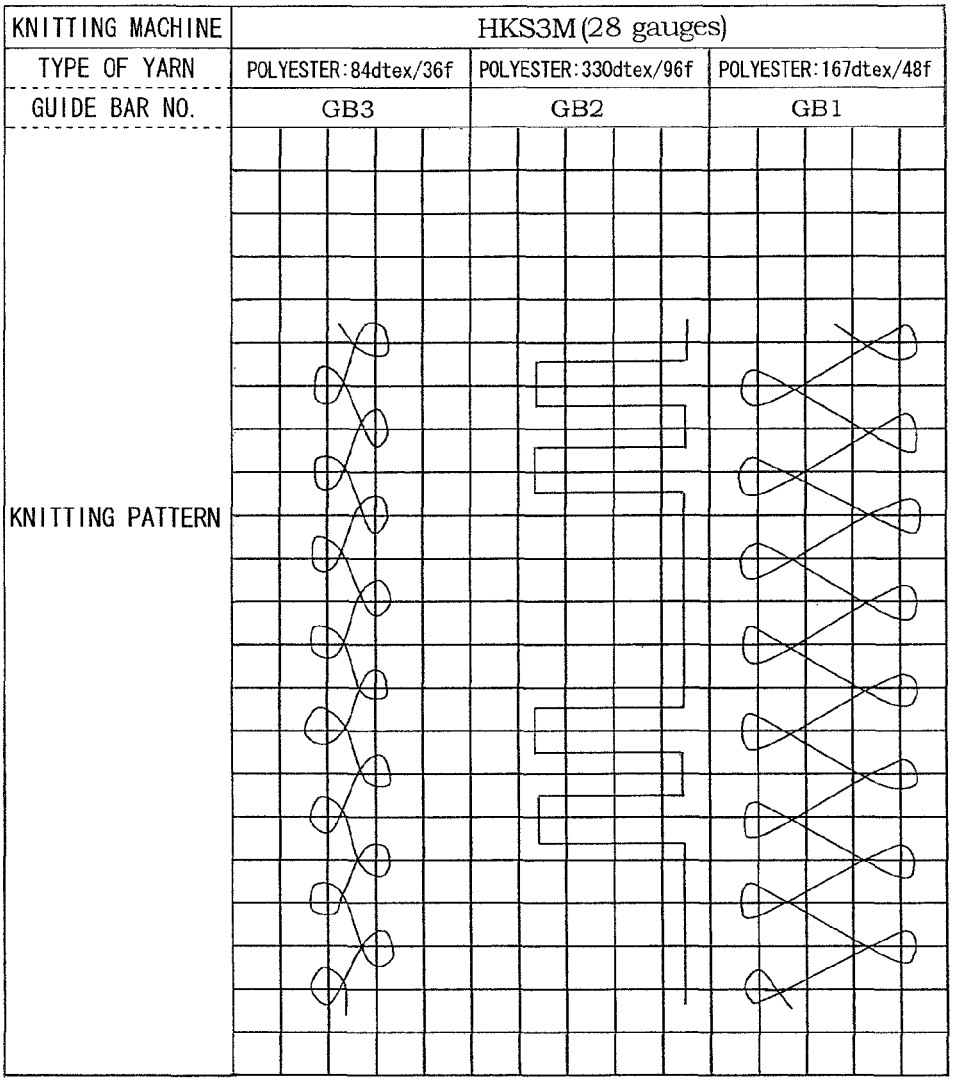
FIG. 6 is a texture chart of lapping states of respective guide bars illustrating examples of warp knitted fabrics of t he present invention.

For example, in the stitch texture illustrated in FIG. 6, the base yarns 1 supplied by the front guide bar GB1 is knitted into the cord stitch texture formed by underlapping the base yarns 1 by an amount corresponding to three needles, and the other base yarns 3 supplied by the back guide bar GB3 is knitted into the denbigh stitch texture formed by underlapping the base yarns 3 by an amount corresponding to one needle and, simultaneously, the insertion yarns 2 supplied by the guide bar (middle guide bar) GB2 as the insertion guide bar is knitted by underlapping in the same direction and by an amount corresponding to the same number of needles (an amount corresponding to three needles) as the underlap of the base yarns 1 so as to match the underlap of the base yarns 1 supplied by the front guide bar GB1 at a required course position over four courses, and subsequently, is knitted so as to repeat insertion of non-underlapped knitting performed by a required number of courses in the warp direction.

Accordingly, portions of the insertion yarns 2 over the four courses inserted by being underlapped are not held by the sinker loops 1*a* of the base yarns 1 supplied by the front guide bar GB1, but are exposed at the sinker-loop-side surface 11 of the warp knitted fabric of the base yarns 1 of the front guide bar GB1 across the sinker loops 1*a*, while other portions of the insertion yarns 2, that is, the portions inserted in the warp direction without being underlapped (the portions of 2*b* in FIG. 4) are not exposed at the sinker-loop-side surface 11 over the required number of courses and, for example, are held and fixed by being sandwiched between the stitch texture of the base yarns 1 supplied by the front guide bar GB1 and the stitch texture of the other base yarns 3 supplied by the back guide bar GB3. Consequently, the exposed portions 2*a* of the sinker-loop-side surface 11 of the insertion yarns 2 are formed intermittently at predetermined intervals in the warp direction (knitting direction).

Figure 2:
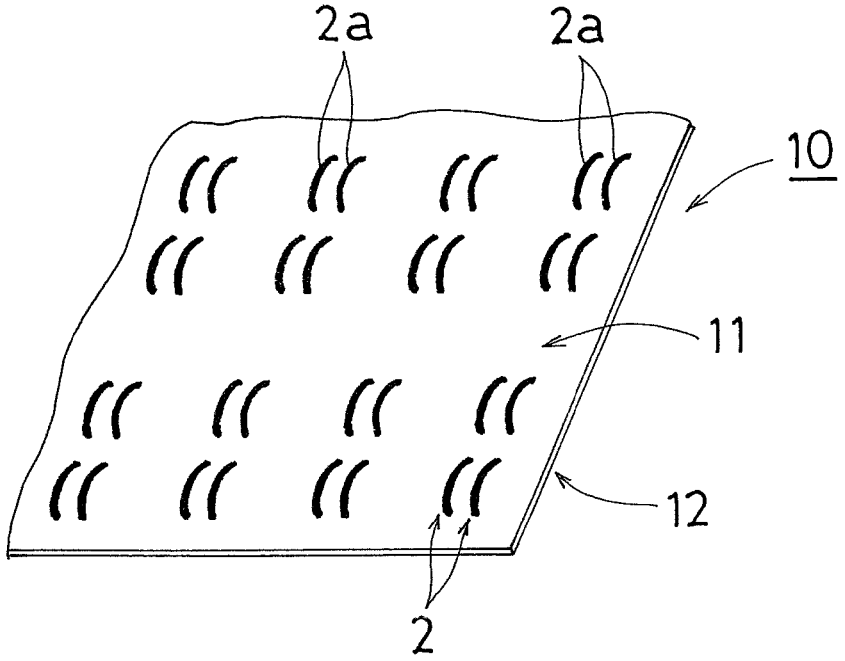
FIG. 2 is a schematic perspective view illustrating an example of a warp knitted fabric of the present invention.

Therefore, by setting the number of courses of the exposed portions 2*a* of the insertion yarns 2 on the sinker-loop-side surface 11 (the number of courses to be underlapped) and the number of courses not to be exposed as needed for knitting, the exposed portions 2*a* may be formed intermittently so as to form rows having a given length in the warp direction at given intervals. Also, by knitting the insertion yarns 2 supplied by the guide bar (middle guide bar) GB2 by performing an open work as needed and introducing, for example, in a 2-in 4-out pattern, the exposed portions 2*a* of the insertion yarns 2 form pairs of rows arranged so as to be aligned in rows at intervals in a knitting width direction as schematically illustrated in FIG. 2.

Figure 5:
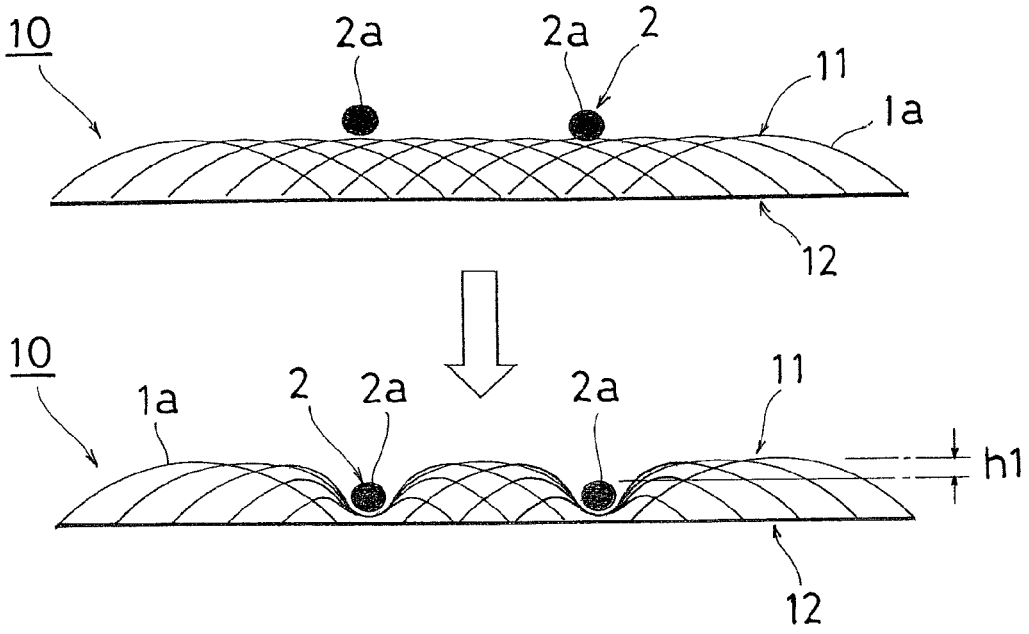
FIG. 5 is a schematic explanatory enlarged cross-sectional view illustrating part of a warp knitted fabric of the present invention.

In addition, the exposed portions 2*a* of the insertion yarns 2 exposed at the sinker-loop-side surface 11 holds partially protrusions of the sinker loops 1*a* of the base yarns 1 forming the sinker-loop-side surface 11 by a tensile force of the knitting (FIG. 5). Consequently, fine concavities and convexities are formed over the entire surface of the sinker-loop-side surface 11 of the warp knitted fabric.

For example, in the case of the cord stitch texture formed by the underlap of the base yarns 1 supplied by the front guide bar GB1 by an amount corresponding to three needles as illustrated in FIG. 6, the exposed portions 2*a* across two courses formed by the underlap of the insertion yarns 2 hold the sinker loops 1*a* of six base yarns 1 as illustrated in FIG. 4, while the exposed portions 2*a* continuing over four courses hold twelve sinker loops 1*a*. In a case where the base yarns 1 supplied by the front guide bar GB1 are the denbigh stitch texture, although not illustrated, the exposed portions over two courses formed by the underlap of the insertion yarns hold two sinker loops, and the exposed portions over four continuous courses hold four sinker loops. Therefore, in terms of an effect of holding by the exposed portions 2*a* of the insertion yarns 2, the cord stitch texture formed by performing the underlap by two or more needles by the base yarns 1 is preferable.

Although the insertion yarns 2 may be knitted by introduced as a full set by a single guide bar (middle guide bar) GB2, in this case, the exposed portions 2*a* of the insertion yarns 2 are formed in the width direction without any intervals therebetween and hence the effect of the fine concavities and convexities is reduced. Therefore, in practice, the open work as described above is preferably performed as needed.

Figure 3:
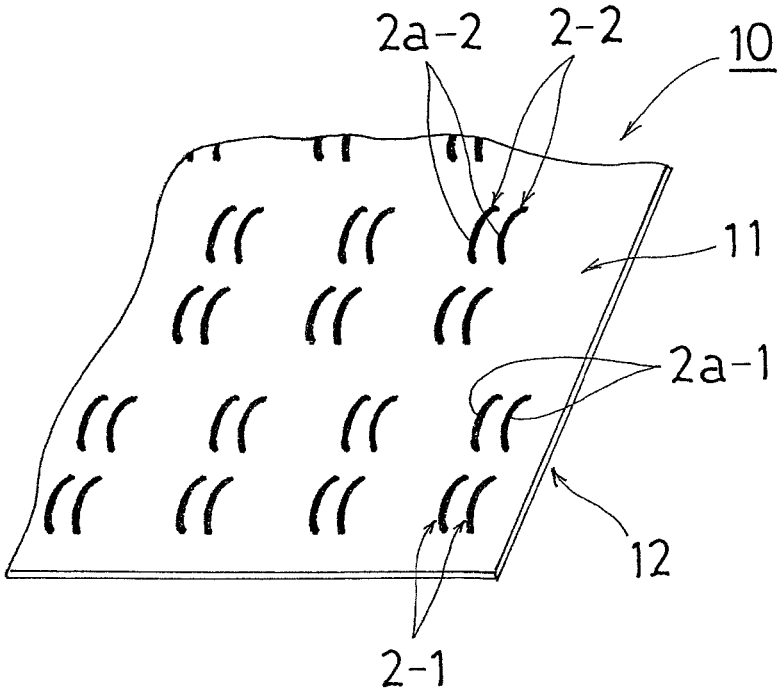
FIG. 3 is a schematic perspective view illustrating another example of a warp knitted fabric of the present invention.

The insertion guide bar used for supplying the insertion yarns 2 is not limited to the single guide bar (middle guide bar) GB2, and two of the guide bars may be used as the insertion guide bars for knitting. For example, as illustrated in an example of the stitch texture in FIG. 7, in the knitting using the warp knitting machine having four guide bars including two middle guide bars (in FIG. 7, the reference numerals of the four guide bars are indicated in a manner different from a normal case and the middle guide bars used as the insertion guide bars are indicated by the same number with branch numbers), the two guide bar (middle guide bars) GB2-1, GB2-2 are used as the insertion guide bars, the insertion yarns 2-1, 2-2 are introduced alternately in, for example, a 2-in 10-out pattern, by the two guide bar (middle guide bars) GB2-1, GB2-2, the underlap is performed on the cord stitch texture to be subject to the underlap by the base yarns 1 supplied from the front guide bar GB1 by an amount corresponding to three needles in the same direction by an amount corresponding to the same number of needles (three needles) as the underlap of the base yarns 1 across four courses alternately at intervals of every required courses respectively in the warp direction (the knitting direction) at different course positions for the underlap, and for other courses, insertion of the same in the warp direction is repeated without performing the underlap, whereby the warp knitted fabric may be knitted. In this case, as schematically illustrated in FIG. 3, pairs of two rows of exposed portions 2*a*-1, 2*a*-2 of the both insertion yarns 2-1, 2-2 are formed on the sinker-loop-side surface 11 of the warp knitted fabric 10 so as to be aligned in rows in a zigzag manner in the warp direction.

In this example as well, by knitting in a chain stitch texture, the denbigh stitch texture or the cord stitch texture by the base yarns 3 supplied by the back guide bar GB3, the portions of the insertion yarns 2-1, 2-2 inserted in the warp direction without being underlapped are sandwiched between the stitch texture of the base yarns 1 supplied by the front guide bar GB1 and the stitch texture of the base yarns 3 supplied by the back guide bar GB3, so that the insertion yarns 2-1, 2-2 are easily fixed.

Figure 7:
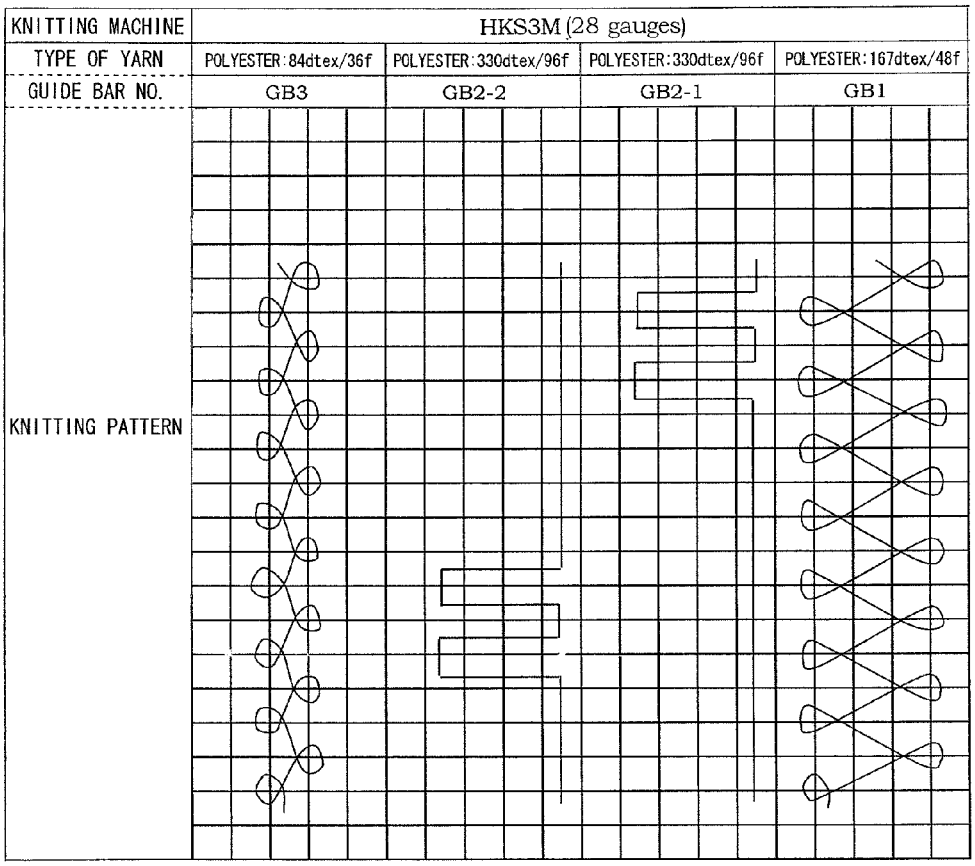
FIG. 7 is a texture chart of the lapping states of the respective guide bars according to other examples of warp knitted fabrics of the invention.
Figure 8:
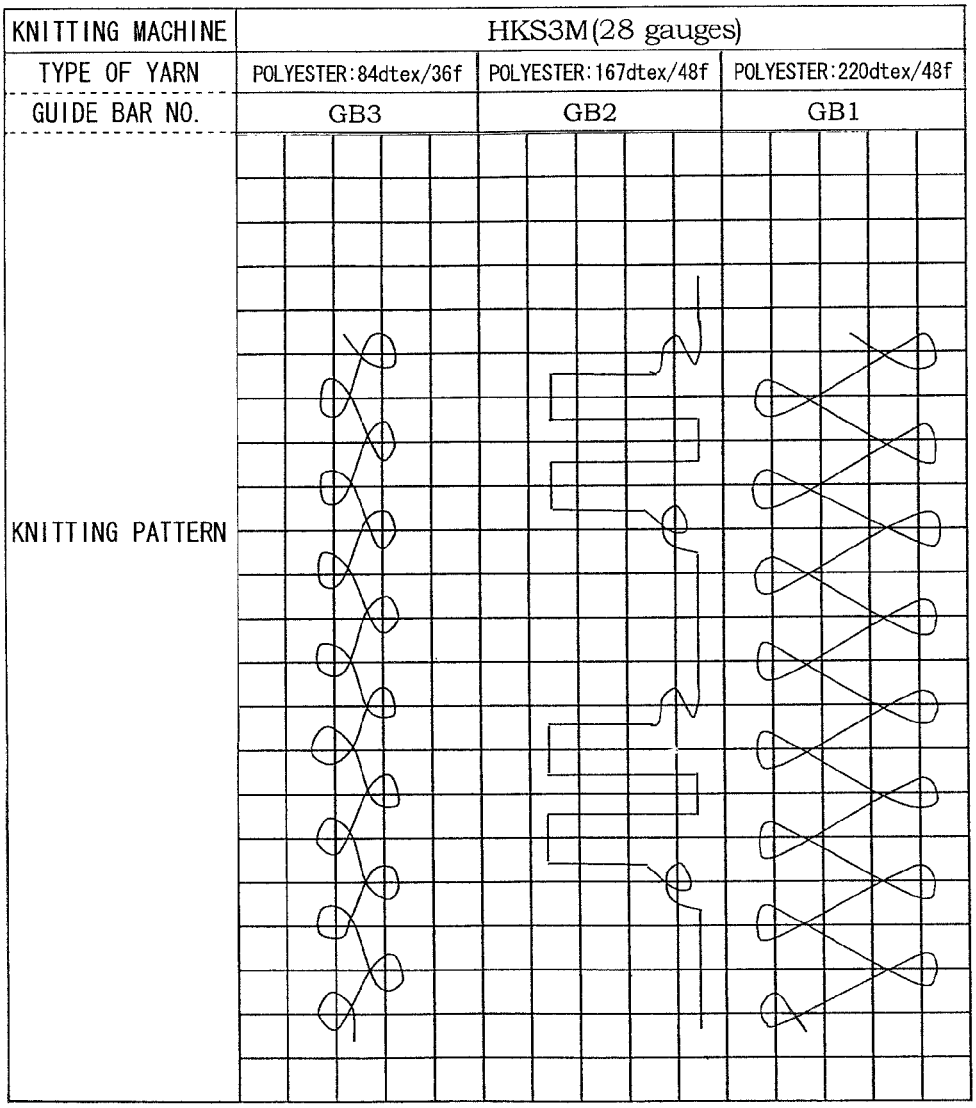
FIG. 8 is a texture chart of the lapping states of t he respective guide bars according to still other examples of warp knitted fabrics of the invention.

Also, a method of engaging with respect to the base texture (the stitch texture with the base yarns 1, 3) at courses before and after the portions where the insertion yarns 2 are underlapped and exposed at the sinker-loop-side surface 11, that is, at courses at both end portions in the knitting direction of the portions inserted into the warp direction without being underlapped may be an insertion engagement without forming loops (looping), or may be an knitting engagement by forming loops (looping). However, in terms of physical properties, in particular, an anti-pilling performance or an abrasion resistance, the knitting engagement is preferable. The stitch texture in FIG. 8 illustrates an example in a case where loops are formed (looping) at courses before and after the portions where the insertion yarns 2 supplied by the guide bar (middle guide bar) GB2 as the insertion guide bar of the stitch texture in FIG. 6 are underlapped and exposed at the sinker-loop-side surface 11. In this case, the insertion yarns 2 are integrated with the base texture at the portion where the loops are formed, and hence are fixed stably. The same is applied to the case where two of the guide bar (middle guide bars) GB2-1, GB2-2 are used as the insertion guide bars in FIG. 7.

In addition, according to the present invention, the warp knitted fabric of the present invention may be knitted without using the base yarns 3 supplied by the back guide bar GB3. In this case, if the insertion yarns are inserted linearly in the warp direction without being underlapped, a linear inserted portions are exposed at the needle-loop-side surface 12 and hence are not held in an interior of the base texture. Therefore, it is preferable to knit so as to weave within the base texture by forming loops (looping) as the denbigh stitch texture over at least part, preferably all, of the courses between portions underlapped to be exposed at the sinker-loop-side surface 11 are interweaved, for example, as illustrated in the stitch texture in FIG. 9 (the courses corresponding to the portions linearly inserted in the warp direction).

Also, as the middle guide bar GB2 of the texture chart in FIG. 8, it is also possible to form loops (looping) only over the courses before and after the portions where the insertion yarns are underlapped and exposed at the sinker-loop-side surface and expose inserted portions other than those at the needle-loop-side surface.

In addition to the respective examples described above, the present invention may also be implemented with the warp knitting machine having four or more guide bars having a plurality of back base guide bars that supplies other base yarns by knitting the insertion yarns so as to be exposed intermittently at the sinker-loop-side surface by arranging the front guide bars that supplies the base yarns and the guide bars (middle guide bars) that supplies the insertion yarns in the same manner as described above. In addition, as regards front guide bars that supplies the base yarns 1, knitting may be achieved by using not only the single front guide bar, but also a plurality of the guide bars may be used as the base guide bars.

In any examples, since the exposed portions 2*a* of the insertion yarns 2 at the sinker-loop-side surface 11 holds partially the protrusions of the sinker loops 1*a* of the base yarns 1 supplied by a front guide bar GB1 that forms the sinker-loop-side surface 11, so that fine concavities and convexities are formed over the entire surface of the sinker-loop-side surface 11 of the warp knitted fabric 10.

The extent of the fine concavities and convexities formed by being held by the exposed portions 2*a* of the insertion yarns 2 depends on the tensile force, the type, and the thickness of the insertion yarns 2 and the number of times of the underlap, the type, and the thickness of the base yarns 1, and may be set as needed by the combination thereof. However, in practice, a level difference h1 (FIG. 5) between the exposed portions 2*a* of the insertion yarns 2 and apexes of a sinker loops of the base yarns 1 (apexes of arcs) is 0.1 mm or more, more preferably 0.1 to 0.6 mm, and further preferably, 0.1 to 0.3 mm. When the level difference hl is smaller than 0.1 mm, stickiness or dampness may not be resolved.

The ratio of the insertion yarns 2 exposed at the sinker-loop-side surface 11 is preferably 5 to 35% and, more preferably, 5 to 20%. When the ratio is lower than 5%, stickiness or dampness may not be resolved. When the ratio exceeds 35%, the physical property, specifically, the anti-pilling performance or the abrasion resistance may be degraded.

The method of calculating the ratio of the insertion yarns 2 exposed at the sinker-loop-side surface 11 is as follows.

$$\text{Ratio}=[c\times w\times\{A/(A+B)\}\times\{C/(C+D)\}]/(c\times w)\times 100$$

c: course density w: well density

A: number of insertion yarns (A-in B-out pattern)

B: number of open works of insertion yarns (A-in B-out pattern)

C: number of courses where insertion yarns are exposed continuously in the warp direction on the sinker-loop-side surface D: number of courses where insertion yarns are not exposed continuously in the warp direction on the sinker-loop-side surface Here, as a state in which the number of courses where the insertion yarns are not exposed at the sinker-loop-side surface, not only the state in which the portions not underlapped and inserted in the warp direction is held by being sandwiched between the stitch texture formed of the base yarns of the front guide bar and the stitch texture formed of the other base yarns of the back guide bar, but also the state of being exposed at the needle-loop-side surface, and the state of forming loops and being held by the base texture are included.

As described above, since the warp knitted fabric 10 of the present invention is formed with the fine concavities and convexities on the sinker-loop-side surface 11, the contact surface area with human bodies (skin surface) at the time of being seated is reduced when the warp knitted fabric 10 is used as the epidermis material of the seat, so that stickiness and damp at the time of sweating may be resolved. In addition, since the insertion yarns are used for forming the fine concavities and convexities on the surface, the length of the yarn required for forming the warp knitted fabric may be reduced, so that a light-weight warp knitted fabric is achieved. In addition, by holding the sinker loops of the base yarns by the insertion yarns, the physical property, more specifically, the anti-pilling performance and the abrasion resistance are improved.

The number of courses where the insertion yarns 2 continuously exposed at the sinker-loop-side surface 11 is preferably 2 to 12 courses and, more preferably, 2 to 8 courses. In the case of course less than 2 courses, the level difference h1 between the exposed portions 2*a* of the insertion yarns 2 and the apexes of the sinker loops by the base yarns 1 is reduced, so that stickiness and damp may not be resolved. In the case of courses exceeding 12 courses, the physical property, specifically, the anti-pilling performance or the abrasion resistance may be degraded.

Also, the warp knitted fabric 10 of the present invention has effects such as preventing forward, rearward, leftward, and rightward twisting at the time of being seated (preventing the sinker loops from being twisted by rubbing the surface forward, rearward, leftward and rightward with a hip when seated, and being changed in appearance) and reducing a noise.

According to the present invention, fibers used for the insertion yarns are not specifically limited. In terms of the physical property, a polyester fiber is preferable.

Also, the form of the yarns used as the insertion yarns is not specifically limited. The yarns may be either a span yarn or a filament yarn (either mono- or multi-). It may be a textured yarn, which is obtained by applying a post process on the filament yarn. The form of the yarn may be set as needed according to the object. Functionality may be provided if the yarns having functionality (yarns having water absorbability), and design properties are provided if the yarns having high design properties (lame yarns or mole yarns) are used. As the insertion yarns, the yarns in different colors or of different types from the base yarn may be used. Accordingly, the exposed portion of the insertion yarns may be presented as a pattern on the sinker-loop-side surface.

Fineness of the insertion yarns is preferably 56 to 550 dtex and, more preferably, 84 to 330 dtex. If the fineness is lower than 56 dtex, the level difference between the insertion yarn and the sinker loop is reduced, so that stickiness and damp may not be resolved. When the fineness exceeds 550 dtex, the physical property, specifically, the anti-pilling performance or the abrasion resistance may be degraded.

Also, the fiber used as the base yarns is not specifically limited. In terms of the physical property, the polyester fiber is preferable.

Also, the form of the line of thread used as the base yarns is not specifically limited. The yarns may be either the span yarn or a filament (either mono- or multi-). It may be a textured yarn, which is obtained by applying a post process on a filament yarn. The form of the yarn may be set as needed according to the object.

Fineness of the base yarns is preferably 56 to 550 dtex and, more preferably, 84 to 330 dtex. If the fineness is lower than 56 dtex, the protrusions of the sinker loops are not sufficient, and hence the level difference between the insertion yarn and the sinker loop is reduced, so that stickiness and damp may not be resolved, or the strength or elastic properties of obtained warp knitted fabric may be deteriorated. When the fineness exceeds 550 dtex, texture of the obtained warp knitted fabric may become rough and hard, or elastic properties may be degraded.

The intervals of the underlap of the base yarns in the width direction is preferably from 2 to 8 needles and, more preferably, 3 to 6 needles. If the intervals of the underlap are smaller than 2 needles, the protrusions of the sinker loops are not sufficient, and hence the level difference between the insertion yarn and the sinker loop is reduced, so that stickiness and damp may not be resolved. If the intervals of the underlap exceeds 8 needles, the texture of the knitted fabric may become rough and hard, or the physical property, specifically, the anti-pilling performance or the abrasion resistance may be degraded.

A known post process of the related art (dyeing, heat treatment, and the like) may be performed on the obtained warp knitted fabric 10. Furthermore, when raising process is applied on the sinker-loop-side surface 11, the level difference between the exposed portions 2*a* of the insertion yarns 2 and the sinker loops 1*a* becomes apparent, which is preferable.

EXAMPLES

[Items of Evaluation]

<Level Difference Between Insertion Yarns and Sinker Loops>

The widthwise cross section of a sample is observed with a microscope, and a level difference between an insertion yarns and apexes of a sinker loops is measured.

<Anti-Pilling Performance>

Abrasion was caused according to JIS L1018 8.18.3 C Method (Taber Type Method), and the appearance was evaluated as shown below.

circle . . . no abnormality triangle . . . rather damaged cross . . . base yarn or insertion yarn was cut <Stickiness, Damp>

A seat cover was made with a test fabric and put on a car seat and, in this state, an organoleptic evaluation about stickiness and damp when being seated for one hour under a room temperature of 25° C. and a humidity of 60% RH was conducted.

circle . . . no feeling of stickiness and damp triangle . . . felt stickiness and damp to a certain extent cross . . . felt stickiness and damp Example 1

A 28-gauge tricot knitting machine having three guide bars (HKS3M: MEYER JAPAN Co., Ltd.) was used, and a warp knitted fabric was knitted by forming a cord texture (three-needle underlap) by introducing a full set of polyester multi-filament yarns of 167 dtex/48 f to the front guide bar GB1 as base yarns, an insertion texture by introducing the polyester multi-filament yarns of 330 dtex/96 f in a 2-in 4-out pattern to the middle guide bar GB2 as insertion yarns, and a denbigh texture by introducing a full set of the polyester multi-filament yarns of 84 dtex/36 f to the back guide bar GB3 as another base yarns, as illustrated in FIG. 6. At this time, the number of courses on which insertion yarns are exposed at a sinker-loop-side surface continuously in a warp direction was four, and the number of hidden courses without being exposed was four.

The obtained warp knitted fabric was preset for one minute at 190° C., then was dyed at 130° C. and dried, and then was set for finishing for one minute at 150° C., whereby the warp knitted fabric finished so as to have 45 courses/inch and 30 wells/inch was fabricated.

The percentage of the insertion yarns exposed at the sinker-loop-side surface was 16.7%, a level difference between the insertion yarn and sinker loops was 0.2 mm.

The obtained result of evaluation of the warp knitted fabric was shown in Table 1. There was no problem in anti-pilling performance, stickiness, and damp.

Example 2

A 28-gauge tricot knitting machine having four guide bars (HKS4M: MEYER JAPAN Co., Ltd.) was used. A warp knitted fabric was knitted by forming insertion textures with underlapped courses at different positions by introducing by using the two guide bars (middle guide bars) GB2-1, GB2-2, and knitting base yarns as in Example 1 by using a front guide bar GB1 and a back guide bar GB3 as illustrated in FIG. 7. The insertion textures are formed by using GB2-1 and GB2-2, by introducing polyester multifilament red spun-colored yarns of 330 dtex/96 f to the middle guide bar GB2-1 as the insertion yarns and polyester multifilament blue spun-colored yarns of 330 dtex/96 f to the middle guide bar GB2-2 as the insertion yarns. Each of the red spun-colored yarns and the blue spun-colored yarns are introduced alternately in a 2-in 8-out pattern. At this time, the number of courses on which insertion yarns are exposed at a sinker-loop-side surface continuously in a warp direction was four, and the number of hidden courses without being exposed was eight.

The obtained warp knitted fabric was finished in the same manner as Example 1 and the warp knitted fabric finished so as to have 45 courses/inch and 32 wells/inch was fabricated.

The percentage of insertion yarns exposed at the sinker-loop-side surface was 13.3%, the level difference between the insertion yarn and sinker loops was 0.2 mm.

The obtained result of evaluation of the warp knitted fabric was shown in Table 1. There was no problem in anti-pining performance, stickiness, and damp. Good design properties were obtained.

Example 3

The same tricot knitting machine as in Example 1 was used, and a warp knitted fabric was knitted by forming a cord texture (three-needle underlap) by introducing a full set of polyester multi-filament yarns of 220 dtex/48 f to the front guide bar GB1 as base yarns, an insertion texture formed with loops (looping) only on the course before and after an underlapped portion by introducing the polyester multi-filament yarns of 167 dtex/48 f in a 2-in 4-out pattern to the middle guide bar GB2 as insertion yarns, and a denbigh texture by introducing a full set of the polyester multifilament yarns of 84 dtex/36 f to the back guide bar GB3 as another base yarns, as illustrated in FIG. 8. At this time, the number of courses on which the insertion yarns are exposed at a sinker-loop-side surface continuously in the warp direction was four, and the number of hidden courses without being exposed was four.

The obtained warp knitted fabric was finished in the same manner as Example 1 and the warp knitted fabric finished so as to have 45 courses/inch and 30 wells/inch was fabricated.

The percentage of the insertion yarns exposed at the sinker-loop-side surface was 16.7%, a level difference between the insertion yarn and sinker loops was 0.2 mm.

The obtained result of evaluation of the warp knitted fabric was shown in Table 1. There was no problem in an anti-pilling performance, stickiness, and damp.

Example 4

Figure 9:
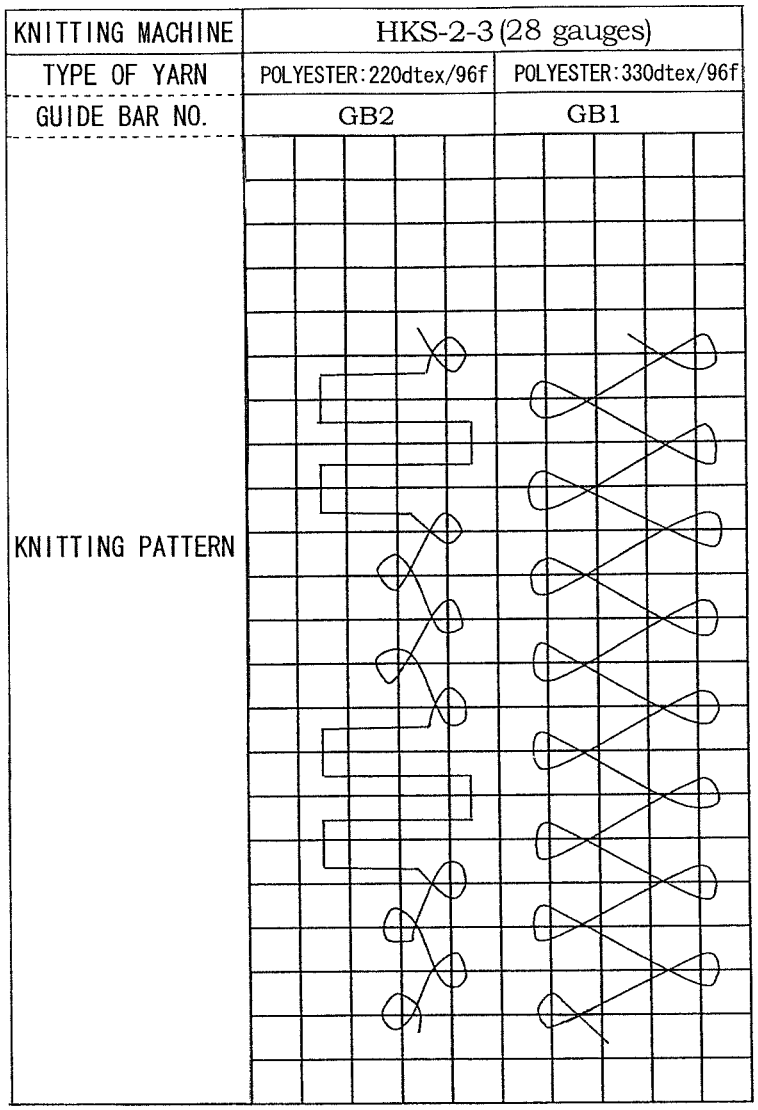
FIG. 9 is a texture chart of the lapping states of the respective guide bars according to still other examples of warp knitted fabrics of the invention.

A 28-gauge tricot knitting machine having two guide bars (HKS-2-3: MEYER JAPAN Co., Ltd.) was used, and a warp knitted fabric was knitted by forming a cord texture (three-needle underlap) by introducing a full set of polyester multi-filament yarns of 330 dtex/96 f to the front guide bar GB1 as base yarns, and a denbigh texture in respective courses other than the courses underlapped and inserted by introducing the polyester multifilament yarns of 220 dtex/96 f in a 2-in 4-out pattern to another one guide bar GB2 as insertion yarns, as illustrated in FIG. 9. At this time, insertion yarns are integrated with the warp knitted fabric other than parts being underlapped and exposed at the sinker-loop-side surface 11 continuously in the warp direction. At this time, the number of courses on which the insertion yarns are exposed at the sinker-loop-side surface continuously in the warp direction was four, and the number of hidden courses without being exposed was four.

The obtained warp knitted fabric was finished in the same manner as Example 1 and the warp knitted fabric finished so as to have 38 courses/inch and 36 wells/inch was fabricated.

The percentage of the insertion yarns exposed at the sinker-loop-side surface was 16.7%, a level difference between the insertion yarn and sinker loops was 0.2 mm.

The obtained result of evaluation of the warp knitted fabric was shown in Table 1. There was no problem in an anti-pilling performance, stickiness, and damp.

Example 5

Figure 10:
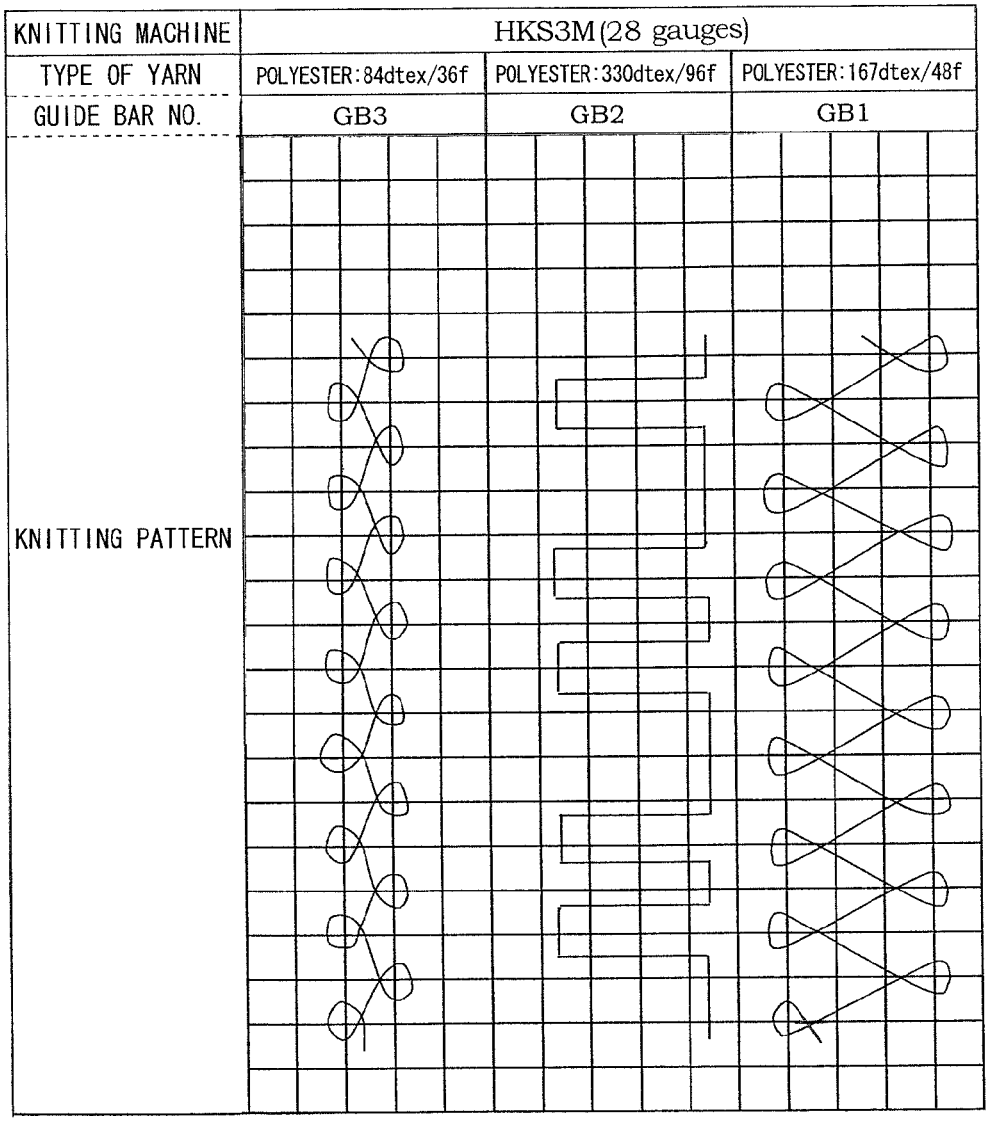
FIG. 10 is a texture chart of the lapping states of the respective guide bars according to still other examples of warp knitted fabrics of the invention.

As illustrated in FIG. 10, the same knitting as that in Example 1 was performed except that the insertion yarns are introduced to the middle guide bar GB2 in a 3-in 1-out pattern, and that the number of courses on which the insertion yarns are exposed at the sinker-loop-side surface continuously in the warp direction was four and the number of hidden courses without being exposed was two.

The obtained warp knitted fabric was finished in the same manner as Example 1 and a warp knitted fabric finished so as to have 45 courses/inch and 30 wells/inch was fabricated.

The percentage of the insertion yarns exposed at the sinker-loop-side surface was 50%, the level difference between the insertion yarn and the sinker loops was 0.2 mm.

The obtained result of evaluation of the warp knitted fabric was shown in Table 1. The ratio of exposure of the insertion yarns was beyond the upper limit of the preferable range, and hence the anti-pilling performance was rather degraded.

Example 6

Figure 11:
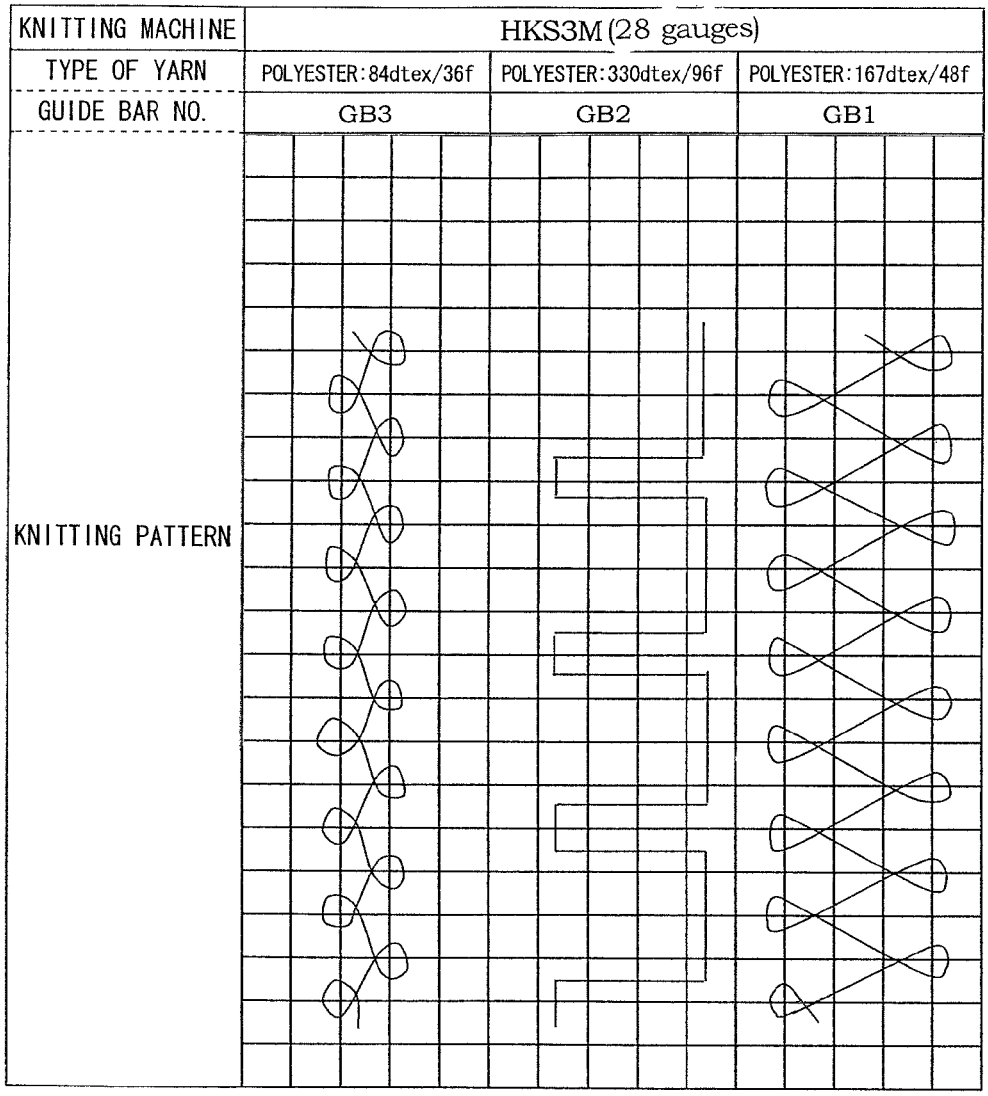
FIG. 11 is a texture chart of the lapping states of the respective guide bars according to still other examples of warp knitted fabrics of the invention.

As illustrated in FIG. 11, the same knitting as that in Example 1 was performed except that the insertion yarns are introduced to the middle guide bar GB2 in a 1-in 5-out pattern, and that the number of courses on which the insertion yarns are exposed at the sinker-loop-side surface continuously in the warp direction was one and the number of hidden courses without being exposed was three.

The obtained warp knitted fabric was finished in the same manner as Example 1 and a warp knitted fabric finished so as to have 45 courses/inch and 30 wells/inch was fabricated.

The percentage of the insertion yarns exposed at the sinker-loop-side surface was 4.2%, the level difference between the insertion yarns and the sinker loops was 0.2 mm.

The obtained result of evaluation of the warp knitted fabric was shown in Table 1. The ratio of exposure of the insertion yarns did not reach the lower limit of the preferable range, and hence the stickiness and damp was rather degraded.

Example 7

Figure 12:
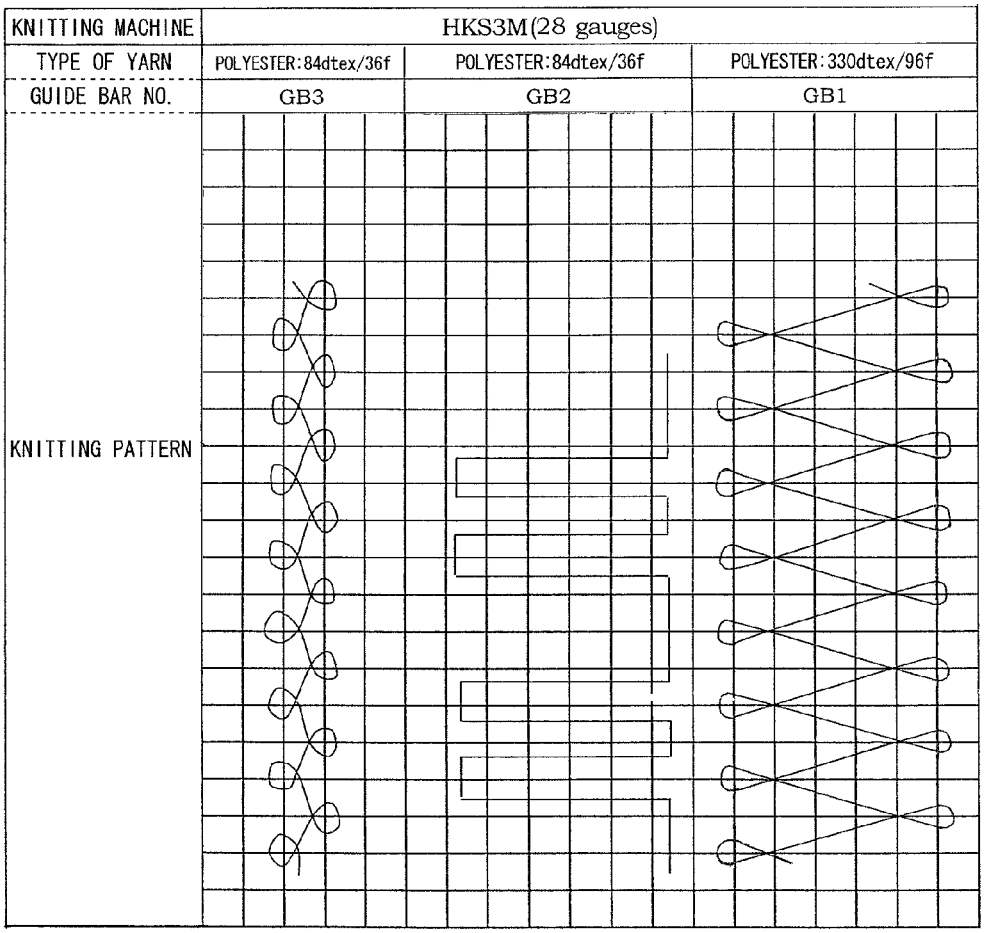
FIG. 12 is a texture chart of t he lapping states of the respective guide bars according to still other examples of warp knitted fabrics of the invention.

The same tricot knitting machine as in Example 1 was used, and a warp knitted fabric was knitted by forming a cord texture (five-needle underlap) by introducing a full set of polyester multi-filament yarns of 330 dtex/96 f to the front guide bar GB1 as base yarns, an insertion texture by introducing polyester multi-filament yarns of 84 dtex/36 f in a 2-in 2-out pattern to the middle guide bar GB2 as insertion yarns, and a denbigh texture by introducing a full set of polyester multifilament yarns of 84 dtex/36 f to the back guide bar GB3 as another base yarns, as illustrated in FIG. 12. At this time, the number of courses on which the insertion yarns are exposed at the sinker-loop-side surface continuously in the warp direction was four, and the number of hidden courses without being exposed was two.

The obtained warp knitted fabric was finished in the same manner as Example 1 and a warp knitted fabric finished so as to have 42 courses/inch and 32 wells/inch was fabricated.

The percentage of the insertion yarns exposed at the sinker-loop-side surface was 33.3%, the level difference between the insertion yarn and the sinker loops was 0.4 mm.

The obtained result of evaluation of the warp knitted fabric was shown in Table 1. Although the exposed percentage of the insertion yarns was close to the upper limit of the preferable range, there was no problem in anti-pilling performance, stickiness, and damp.

Example 8

Figure 13:
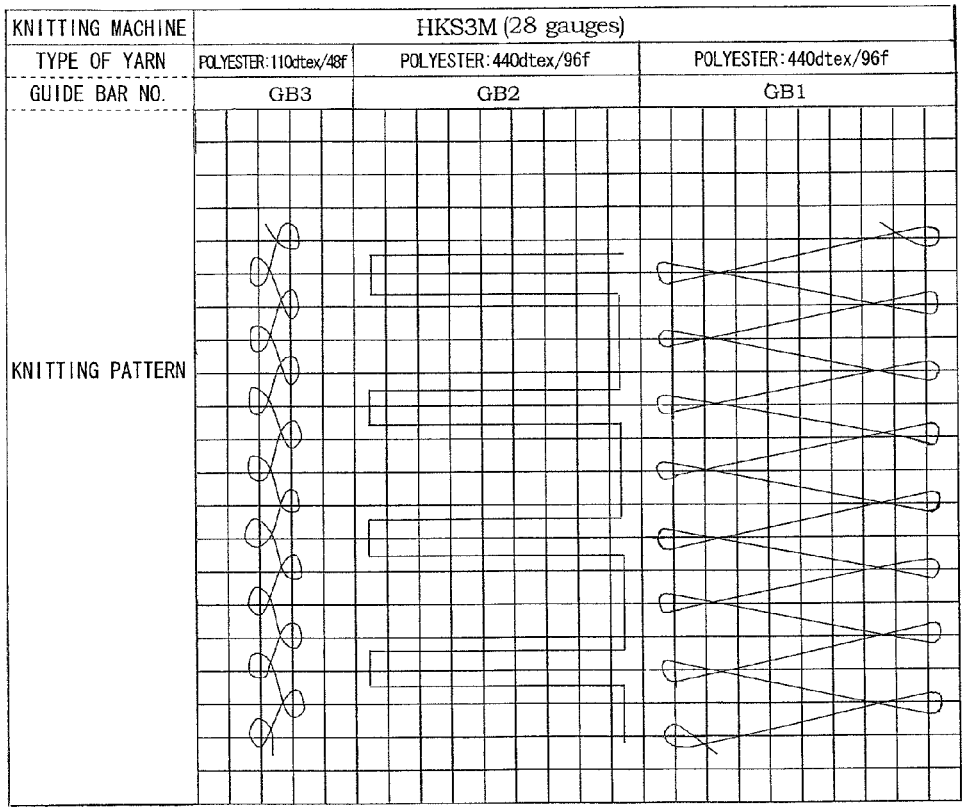
FIG. 13 is a texture chart of the lapping states of the respective guide bars according to still other examples of warp knitted fabrics of the invention.

The same tricot knitting machine as in Example 1 was used, and a warp knitted fabric was knitted by forming a cord texture (eight-needle underlap) by introducing a full set of polyester multi-filament yarns of 440 dtex/96 f to the front guide bar GB1 as base yarns, an insertion texture by introducing polyester multi-filament yarns of 440 dtex/96 f in a 1-in 4-out pattern to the middle guide bar GB2 as insertion yarns, and a denbigh texture by introducing a full set of polyester multifilament yarns of 110 dtex/48 f to the back guide bar GB3 as another base yarns, as illustrated in FIG. 13. At this time, the number of courses on which the insertion yarns are exposed at the sinker-loop-side surface continuously in the warp direction was one, and the number of hidden courses without being exposed was three.

The obtained warp knitted fabric was finished in the same manner as Example 1 and a warp knitted fabric finished so as to have 45 courses/inch, and 34 wells/inch was fabricated.

The percentage of the insertion yarns exposed at the sinker-loop-side surface was 5%, the level difference between the insertion yarn and the sinker loops was 0.6 mm.

The obtained result of evaluation of the warp knitted fabric was shown in Table 1. Although the exposed percentage of the insertion yarns was at the lower limit of the preferable range, there was no problem in anti-pilling performance, stickiness, and damp.

Example 9

Figure 14:
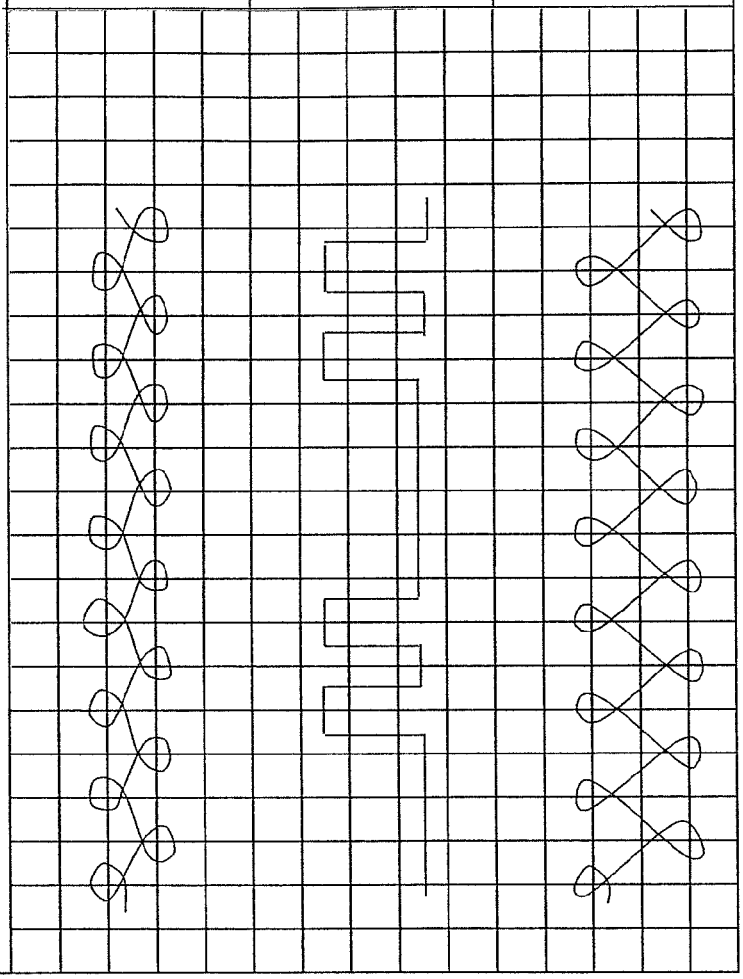
FIG. 14 is a texture chart of the lapping states of the respective guide bars according to still other examples of warp knitted fabrics of the invention.

The same tricot knitting machine as in Example 1 was used, and a warp knitted fabric was knitted by forming a cord texture (two-needle underlap) by introducing a full set of polyester multi-filament yarns of 56 dtex/24 f to the front guide bar GB1 as base yarns, an insertion texture by introducing polyester multi-filament yarns of 56 dtex/24 f in a 2-in 4-out pattern to the middle guide bar GB2 as insertion yarns, and a denbigh texture by introducing a full set of polyester multifilament yarns of 56 dtex/24 f to the back guide bar GB3 as another base yarns, as illustrated in FIG. 14. At this time, the number of courses on which the insertion yarns are exposed at the sinker-loop-side surface continuously in the warp direction was four, and the number of hidden courses without being exposed was four.

The obtained warp knitted fabric was finished in the same manner as Example 1 and a warp knitted fabric finished so as to have 40 courses/inch, and 30 wells/inch was fabricated.

The percentage of the insertion yarns exposed at the sinker-loop-side surface was 16.7%, the level difference between the insertion yarns and the sinker loops was 0.05 mm.

The obtained result of evaluation of the warp knitted fabric was shown in Table 1. The level difference between the insertion yarns and the sinker loops did not reach the lower limit of the preferable range, and hence the stickiness and damp was rather degraded.

Comparative Example 1

Figure 15:
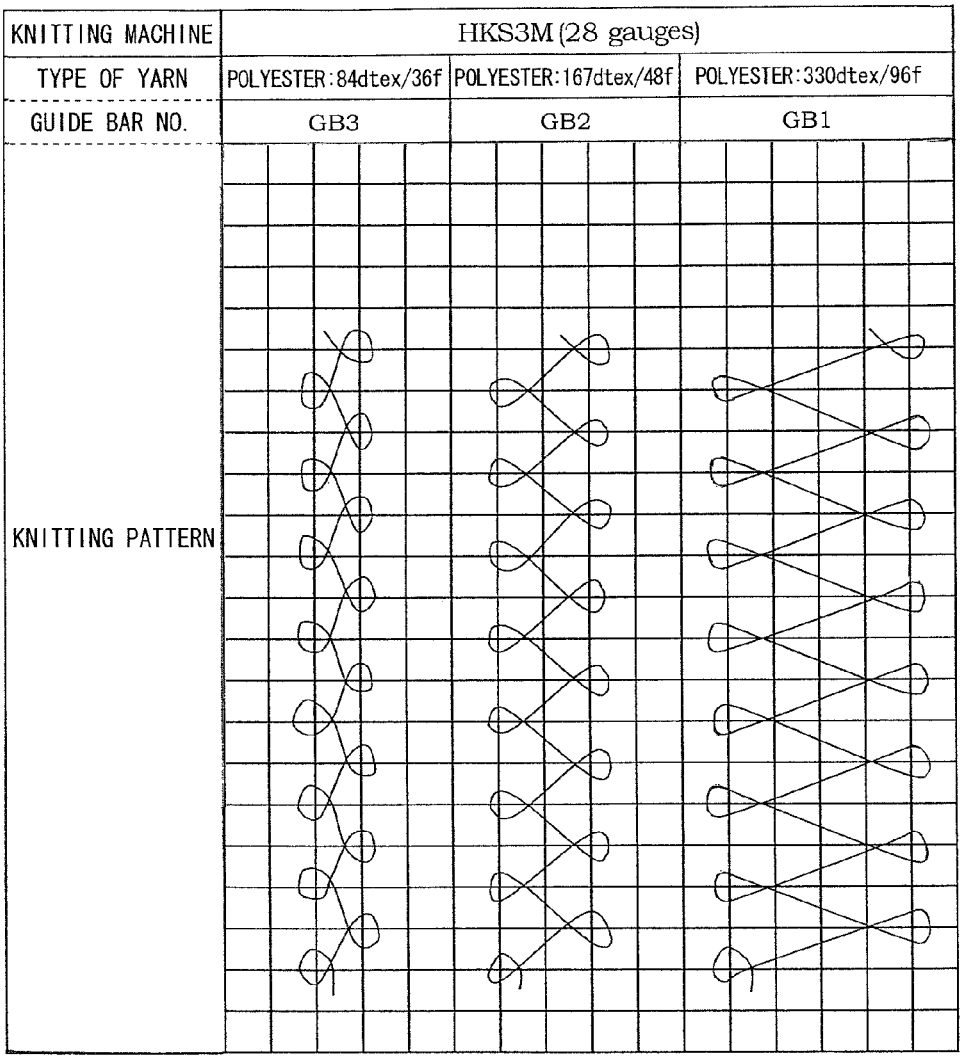
FIG. 15 is a texture chart of the lapping states of the respective guide bars illustrating an example of the warp knitted fabric of a comparative example.

The same tricot knitting machine including three guide bars as Example 1 was used, and a warp knitted fabric was knitted by forming a cord texture (three-needle underlap) by introducing a full set of polyester multi-filament yarns of 330 dtex/96 f to the front guide bar GB1, a cord texture (two-needle underlap) by introducing a full set of polyester multi-filament yarns of 167 dtex/48 f to the GB2, and a denbigh stitch texture by introducing a full set of polyester multifilament yarns of 84 dtex/36 f to the back guide bar GB3, as illustrated in FIG. 15.

The obtained warp knitted fabric was finished in the same manner as Example 1 and a warp knitted fabric finished so as to have 40 courses/inch, and 36 wells/inch was fabricated.

The obtained result of evaluation of the warp knitted fabric was shown in Table 1. The anti-pilling performance, stickiness, and damp were all degraded.

TABLE 1

| | | Example 1 | Example 2 | Example 3 | Example 4 | Example 5 | Example 6 | Example 7 | Example 8 | Example 9 | Comparative Example 1 |
|---|---|---|---|---|---|---|---|---|---|---|---|
| Knitting machine | | HKS3M | HKS4M | HKS3M | HKS-2-3 | HKS3M | HKS3M | HKS3M | HKS3M | HKS3M | HKS3M |
| Number of gauges | | 28 | 28 | 28 | 28 | 28 | 28 | 28 | 28 | 28 | 28 |
| Stitch texture | Base guide bar | GB1: cord (3-needle underlap) full set | GB1: cord (3-needle underlap) full set | GB1: cord (3-needle underlap) full set | GB1: cord (3-needle underlap) full set | GB1: cord (3-needle underlap) full set | GB1: cord (3-needle underlap) full set | GB1: cord (5-needle underlap) full set | GB1: cord (8-needle underlap) full set | GB1: cord (2-needle underlap) full set | GB1: cord (3-needle underlap) full set |
| | Insertion guide gar | GB2: insertion | GB2-1: insertion GB2-2: insertion | GB2: insertion (looping at both ends of hidden portions) | GB2: insertion (looping at all hidden portions) | GB2: insertion | GB2: insertion | GB2: insertion | GB2: insertion | GB2: insertion | GB2: cord (2-needle underlap) |
| | Back base guide bar | 2in4out GB3: denbigh full set | 2in8out GB3: denbigh full set | 2in4out GB3: denbigh full set | 2in4out — — | 3in1out GB3: denbigh full set | 1in5out GB3: denbigh full set | 2in2out GB3: denbigh full set | 1in4out GB3: denbigh full set | 2in4out GB3: denbigh full set | full set GB3: denbigh full set |
| Insertion yarns | Number of exposed courses | 4 | 4 | 4 | 4 | 4 | 1 | 4 | 1 | 4 | — |
| | Number of hidden courses | 4 | 8 | 4 | 4 | 2 | 3 | 2 | 3 | 4 | — |
| | Exposed percentage [%] | 16.7 | 13.3 | 16.7 | 16.7 | 50 | 4.2 | 33.3 | 5.0 | 16.7 | — |
| | Level difference with respect to sinker loops [mm] | 0.2 | 0.2 | 0.2 | 0.2 | 0.2 | 0.2 | 0.4 | 0.6 | 0.05 | — |
| Finished density | Course density [course/inch] | 45 | 45 | 45 | 38 | 45 | 45 | 42 | 45 | 40 | 40 |
| | Well density [well/inch] | 30 | 32 | 30 | 36 | 30 | 30 | 32 | 34 | 30 | 36 |
| Evaluation | Anti-pilling property | ○ | ○ | ○ | ○ | Δ | ○ | ○ | ○ | ○ | x |
| | Stickiness, damp | ○ | ○ | ○ | ○ | ○ | Δ | ○ | ○ | Δ | x |

INDUSTRIAL APPLICABILITY

The warp knitted fabric of the present invention may be used as an epidermis material for seats such as those of automotive vehicles, railroad vehicles, aircrafts, child seats, baby carriages, wheelchairs, furniture, and office chairs.

REFERENCE SIGNS LIST

10 . . . warp knitted fabric
11 . . . sinker-loop-side surface
12 . . . needle-loop-side surface
1 . . . base yarn
2; 2-1, 2-2 . . . insertion yarn
3 . . . another base yarn
1*a* . . . sinker loop
2*a*; 2*a*-1, 2*a*-2 . . . exposed portion of insertion yarn
2*b* . . . portion of insertion yarn to be inserted in warp direction without being underlapped

The invention claimed is:

1. A method of manufacturing a warp knitted fabric comprising:

knitting a denbigh stitch texture or a cord stitch texture by supplying a base yarn by a front guide bar by a warp knitting machine having at least two guide bars;

supplying an insertion yarn by a guide bar rearward of the front guide bar to knit an insertion texture;

knitting the base yarn supplied by the front guide bar by underlapping in a knitting width direction by one or more needles and overlapping the base yarn to said one or more needles to hook around at least one of said one or more needles to form a stitch; and knitting the insertion yarn by underlapping in said knitting width direction by a same number of said one or more needles as for said underlapping of the base yarn, wherein said knitting of the insertion yarn is without looping of said insertion yarn around any of said one or more needles, thereby exposing the insertion yarn at a sinker-loop-side surface of the warp knitted fabric intermittently in a warp direction; and wherein one or a plurality of courses of portions where the insertion yarn supplied by the guide bar rearward of the front guide bar is underlapped and inserted, and one or a plurality of courses of portions where the insertion yarn is inserted in the warp direction without being underlapped are knitted repeatedly and alternately in the warp direction.

2. The method of manufacturing a warp knitted fabric according to claim 1, wherein the insertion yarn is engaged by knitting with loops formed at courses before and after the portions where the insertion yarn is underlapped and inserted, and is continued to the portion to be inserted in the warp direction without being underlapped.

3. A method of manufacturing a warp knitted fabric comprising:

knitting a denbigh stitch texture or a cord stitch texture by supplying a base yarn by a front guide bar by a warp knitting machine having at least two guide bars;

supplying an insertion yarn by a guide bar rearward of the front guide bar to knit an insertion texture;

knitting the base yarn supplied by the front guide bar by underlapping in a knitting width direction by one or more needles and overlapping the base yarn to said one or more needles so that the base yarn is hooked around said one or more needles; and knitting the insertion yarn by underlapping in said knitting width direction by a same number of said one or more needles as for said underlapping of the base yarn, wherein said knitting of the insertion yarn is without looping said insertion yarn, thereby exposing the insertion yarn at a sinker-loop-side surface of the warp knitted fabric intermittently in a warp direction; and wherein one or a plurality of courses of portions where the insertion yarn supplied by the guide bar rearward of the front guide bar is underlapped and inserted, and one or a plurality of courses of knitted portions where loops are formed at the respective courses and engaged by knitting are knitted repeatedly and alternately in the warp direction.

4. The method of manufacturing a warp knitted fabric according to claim 3, comprising:

using two of the guide bars as guide bars for supplying the insertion yarn, supplying the insertion yarns alternately in the knitting width direction by two of the respective guide bars and knitting an inserted texture, and knitting the insertion yarns from the both guide bars by underlapping in the same direction and by an amount corresponding to the same number of needles as the underlap of the base yam supplied by the front guide bar respectively, wherein the insertion yarns from the both guide bars are exposed to the sinker-loop-side surface of the warp knitted fabric intermittently in the warp direction.

5. The method of manufacturing a warp knitted fabric according to claim 3, comprising:

knitting so as to form at least one of a chain stitch texture, the denbigh stitch texture, and the cord stitch texture by supplying another base yarn by the guide bar rearward of the guide bar configured to supply the insertion yarn, and knitting so as to sandwich and hold the portion of the insertion yam not exposed at the sinker-loop-side surface between the stitch texture formed by the base yarn supplied by the front guide bar and the stitch texture formed by the other base yarn supplied by the back guide bar.

6. The method of manufacturing a warp knitted fabric according to claim 1 comprising:

using two of the guide bars as guide bars for supplying the insertion yarn, supplying the insertion yarns alternately in the knitting width direction by two of the respective guide bars and knitting an inserted texture, and knitting the insertion yarns from the both guide bars by underlapping in said knitting width direction by the same number of needles as for said underlapping of the base yam supplied by the front guide bar respectively, wherein the insertion yarns from the both guide bars are exposed to the sinker-loop-side surface of the warp knitted fabric intermittently in the warp direction.

7. The method of manufacturing a warp knitted fabric according to claim 1, comprising:knitting so as to form at least one of a chain stitch texture, the denbigh stitch texture, and the cord stitch texture by supplying another base yarn by the guide bar rearward of the guide bar configured to supply the insertion yarn, and knitting so as to sandwich and hold the portion of the insertion yarn not exposed at the sinker-loop-side surface between the stitch texture formed by the base yarn supplied by the front guide bar and the stitch texture formed by the other base yarn supplied by the back guide bar.

8. A method of manufacturing a warp knitted fabric having a base texture and an inserted texture configured to reduce dampness in response to sweating by a person in contact with the warp knitted fabric, the method being performed with a knitting machine, the method comprising:

knitting at least a portion of the base texture using a plurality of base yarns, a plurality of needles arranged in parallel in a width direction, and a front guide bar located at a front side of the knitting machine, said front side being farthest from said plurality of knitting needles at a time of performing an underlapping operation, said portion of the base texture being a denbigh stitch texture or a cord stitch texture, wherein a stitch of said base texture is formed by a first base yarn of said plurality of base yarns by overlapping said first base yarn so as to be hooked on a needle at one end of a course of underlapping of said first base yarn in a left direction or a right direction relative to the front of the machine, said underlapping occurring alternately in said left direction and said right direction from one course to another course of the base texture for every course formed by said first base yarn of said portion so as to form a plurality of stitches in said portion by said one base yarn, said underlapping comprising underlapping said first base yarn for a series of said plurality of needles so as not to be hooked on a needle of said plurality of needles, said series comprising a first number of said needles greater than one needle; and knitting the inserted texture using a plurality of insertion yams, said plurality of knitting needles and a second guide bar located rearward of said front guide bar, wherein each one insertion yarn of said plurality of insertion yams is inserted to said base texture by underlapping said one insertion yarn to a left direction and a right direction relative to the front of the machine alternatively from one course to another course of the inserted texture for a sequence of courses of said one insertion yarn, said underlapping of said one insertion yarn comprising underlapping said one insertion yarn for a series of said plurality of needles, said series comprising said first number of said needles, wherein following a sequence of insertions of said one insertion yarn formed over said sequence of courses, said one insertion yarn is inserted without underlapping so as to span across a plurality of courses of said base yarns; and wherein said forming of said inserted texture by inserting said one insertion yarn along said sequence of courses exposes said one insertion yarn at a sinker-loop-side surface of the warp knitted fabric intermittently in a warp direction, wherein for a portion of the warp knitted fabric where said one insertion yarn is inserted without underlapping so as to span across said plurality of courses of said base yarns said one insertion yarn is hidden from a sinker-loop-side surface of the warp knitted fabric in said warp direction;

wherein said sequence of inserting by underlapping formed over said sequence of courses and said inserting of said one insertion yarn without underlapping spanning across said plurality of courses of said base yarns alternate repeatedly in said warp direction; and wherein said inserted texture is held to the base texture alternately and intermittently in said warp direction by said insertion of said one insertion yarn with underlapping and by said insertion of said one insertion yarn without underlapping.

9. The method of manutacturing a warp knitted fabric according to claim 8, wherein said portion of the base texture is a first portion and further comprising:

knitting a second portion of the base texture using a plurality of second base yarns, said plurality of needles, and a third guide bar located rearward of said second guide bar, said second portion of the base texture being a chain stitch texture, a denbigh stitch texture, or a cord stitch texture; and wherein a stitch of said second portion is formed by a first base yarn of said plurality of second base yarns by overlapping said first base yarn of said plurality of second base yarns so as to be hooked on a needle at one end of a course of underlapping of said first base yarn of said plurality of second base yarns in a left direction or a right direction relative to the front of the machine, said underlapping occurring alternately in said left direction and said right direction from one course to another course of the second portion for every course formed by said first base yarn of said plurality of second base yarns so as to form a plurality of stitches by said one base yarn of said plurality of second base yarns, said underlapping comprising underlapping said first base yarn of said plurality of second base yarns for one needle so as not to be hooked on said one needle.

10. A method of manufacturing a warp knitted fabric having a base texture and an inserted texture configured to reduce dampness in response to sweating by a person in contact with the warp knitted fabric, the method being performed with a knitting machine, the method comprising:

knitting at least a portion of the base texture using a plurality of base yarns, a plurality of needles arranged in parallel in a width direction, and a front guide bar located at a front side of the knitting machine, said front side being farthest from said plurality of knitting needles at a time of performing an underlapping operation, said portion of the base texture being a denbigh stitch texture or a cord stitch texture, wherein a stitch of said base texture is formed by a first base yarn of said plurality of base yarns by overlapping said first base yarn so as to be hooked on a needle at one end of a course of underlapping of said first base yarn in a left direction or a right direction relative to the front of the machine, said underlapping occurring alternately in said left direction and said right direction from one course to another course of the base texture for every course formed by said first base yarn so as to form a plurality of stitches by said one base yarn, said underlapping comprising underlapping said first base yarn for a series of said plurality of needles so as not to be hooked on a needle of said plurality of needles, said series comprising a first number of said needles greater than one needle; and knitting the inserted texture using a plurality of insertion yarns, said plurality of knitting needles and a second guide bar located rearward of said front guide bar, wherein each one insertion yarn of said plurality of insertion yarns is inserted to said base texture by underlapping said one insertion yarn to a left direction and a right direction relative to the front of the machine alternatively from one course to another course of the inserted texture for a sequence of courses of said one insertion yarn, said underlapping of said one insertion yam comprising underlapping said one insertion yarn for a series of said plurality of needles, said series comprising said first number of said needles, wherein following a sequence of insertions of said one insertion yarn formed over said sequence of courses, said one insertion yarn is inserted so as to span across a plurality of courses of said base yarns; and wherein said forming of said inserted texture by inserting said one insertion yarn along said sequence of courses exposes said one inset Lion yarn at a sinker-loop-side surface of the warp knitted fabric intermittently in a warp direction, wherein for a portion of the warp knitted fabric where said one insertion yarn is so as to span across said plurality of courses of said base yarns said one insertion yarn is hidden from a sinker-loop-side surface of the warp knitted fabric in said warp direction;

wherein said sequence of inserting by underlapping formed over said sequence of courses and said inserting of said one insertion yarn without underlapping spanning across said plurality of courses of said base yarns alternate repeatedly in said warp direction; and wherein the insertion yarn is engaged to the base texture by knitting said one insertion yarn in a loop at a first course and last course of said plurality of courses of said base yarns spanned by said one insertion yarn where said one insertion yarn is inserted without underlapping.

11. The method of manufacturing a warp knitted fabric according to claim 1, wherein said knitting the base yarn supplied by the front guide bar is by underlapping in the knitting width direction by two or more needles and overlapping the base yarn to a first and a last needle of said two or more needles so that the base yarn is hooked around each one of said first and last needle.

12. The method of manufacturing a warp knitted fabric according to claim 3, wherein knitting the base yarn supplied by the front guide bar is by underlapping in a knitting width direction by two or more needles and overlapping the base yarn to a first and a last needle of said two or more needles so that the base-yarn is hooked around each one of said first and last needle; and wherein said knitting the insertion yarn by underlapping in said knitting width direction is by a same number of said two or more needles as for said underlapping of the base yarn, wherein said underlapping of said knitting of the insertion yarn is without hooking the base yarn on said two or more needles along a span of said underlapping of said insertion yarn, thereby exposing the insertion yarn at a sinker-loop-side surface of the warp knitted fabric intermittently in a warp direction.

* * * * *